US011035582B2

(12) United States Patent
Poccianti

(10) Patent No.: US 11,035,582 B2
(45) Date of Patent: Jun. 15, 2021

(54) THERMAL SHELL, IN PARTICULAR FOR A BUILDING

(71) Applicant: AZIENDA AGRICOLA EREDI POCCIANTI S.R.L., Florence (IT)

(72) Inventor: Guido Francesco Poccianti, Florence (IT)

(73) Assignee: AZIENDA AGRICOLA EREDI POCCIANTI S.R.L., Florence (IT)

( * ) Notice: Subject to any disclaimer, the term of this patent is extended or adjusted under 35 U.S.C. 154(b) by 0 days.

(21) Appl. No.: 15/511,620

(22) PCT Filed: Sep. 16, 2015

(86) PCT No.: PCT/IT2015/000227
§ 371 (c)(1),
(2) Date: Mar. 15, 2017

(87) PCT Pub. No.: WO2016/042585
PCT Pub. Date: Mar. 24, 2016

(65) Prior Publication Data

US 2017/0254550 A1 Sep. 7, 2017

(30) Foreign Application Priority Data

Sep. 16, 2014 (IT) ..... RM2014A000525

(51) Int. Cl.
*E04B 1/74* (2006.01)
*F24F 7/08* (2006.01)
(Continued)

(52) U.S. Cl.
CPC ..... *F24F 7/08* (2013.01); *E04B 1/74* (2013.01); *E04B 1/7612* (2013.01); *E04C 2/296* (2013.01);
(Continued)

(58) Field of Classification Search
CPC ..... E02D 31/02; E04D 13/17; E04D 1/7612; E04F 17/00; E04C 2/523; E04C 2/525; F24F 7/08; E04B 1/70; E04B 1/7612
(Continued)

(56) References Cited

U.S. PATENT DOCUMENTS 3,789,747 A 2/1974 Farrar
4,379,449 A 4/1983 Wiggins
(Continued)

FOREIGN PATENT DOCUMENTS

CN 201665924 U 12/2010
CN 201865207 U 6/2011
(Continued)

OTHER PUBLICATIONS

Italian Patent Office Search Report and Written Opinion dated Dec. 16, 2014 (partially in English).
(Continued)

*Primary Examiner* — Vivek K Shirsat
*Assistant Examiner* — Ko-Wei Lin
(74) *Attorney, Agent, or Firm* — Hedman & Costigan, P.C.; James V. Costigan; Kathleen A. Costigan

(57) ABSTRACT

The present invention relates to a thermal shell for a building, apt to constitute a multi-layer system formed by three integral elements having, respectively, from the outside towards the inside: an external peripheral wall/casing with the function of thermal insulating wall; an interspace filled with air to be conditioned; an internal wall/casing with the function of heat-radiating wall/casing; comprising:

a covering structure (10) positioned around the building (1), or part of said building (1), the covering structure (10) comprising, proceeding from the outside towards the inside of the building (1): a coating (11), an insulating layer (16) and an interspace (12); the inter-
(Continued)

space (12) containing air and forming a closed and isolated room with respect to the surrounding environment;

means (13) of thermal conditioning of the air contained in the interspace, so that the shell defines an internal wall/casing.

16 Claims, 10 Drawing Sheets

(51) Int. Cl.

| | |
|---|---|
| ***E04C 2/52*** | (2006.01) |
| ***E04B 1/76*** | (2006.01) |
| ***E04C 2/296*** | (2006.01) |
| *F24F 5/00* | (2006.01) |
| *F24F 7/00* | (2021.01) |

(52) U.S. Cl.
CPC ..... *E04C 2/523* (2013.01); *E04C 2/525* (2013.01); *F24F 2005/0082* (2013.01); *F24F 2007/004* (2013.01); *F24F 2007/0025* (2021.01)

(58) Field of Classification Search
USPC ..... 454/185, 186; 52/302.3
See application file for complete search history.

(56) References Cited

U.S. PATENT DOCUMENTS

| | | | | | |
|---|---|---|---|---|---|
| 4,506,595 | A * | 3/1985 | Roberts | F24F 7/04 | 454/186 |
| 5,561,958 | A | 10/1996 | Clement | | |
| 6,295,823 | B1 * | 10/2001 | Odom | F24F 1/0007 | 165/139 |
| 8,056,252 | B2 * | 11/2011 | Fernandes | E04B 1/7069 | 126/299 D |
| 2002/0017070 | A1 * | 2/2002 | Batch | E04B 2/8617 | 52/309.11 |
| 2004/0020787 | A1 * | 2/2004 | Sano | C02F 1/4618 | 205/628 |
| 2009/0199994 | A1 * | 8/2009 | Amano | C09K 5/063 | 165/10 |
| 2010/0140837 | A1 * | 6/2010 | Biebaut | B28B 1/54 | 264/267 |
| 2011/0042988 | A1 * | 2/2011 | Alpert | B60H 1/2218 | 296/24.3 |
| 2012/0270494 | A1 * | 10/2012 | McCarty | F24F 1/0007 | 454/241 |

FOREIGN PATENT DOCUMENTS

| | | | | |
|---|---|---|---|---|
| CN | 102174857 | A | 9/2011 | |
| DE | 202013104193 | U1 | 11/2013 | |
| JP | 57142436 | A * | 9/1982 | F24F 7/04 |
| WO | 2011/137879 | A2 | 11/2011 | |

OTHER PUBLICATIONS

Notification of Transmittal of the International Search Report and the Written Opinion of the International Searching Authority for PCT/IT2015/000227 dated Dec. 22, 2015.
English Abstract for CN 201665924 U dated Dec. 8, 2010.
English Abstract for CN 201865207 U dated Jun. 15, 2011.
English Abstract for CN 102174857 A dated Sep. 7, 2011.
Office Action from Eurasian Patent Office dated Apr. 10, 2018.
English Translation of Office Action from Eurasian Patent Office dated Apr. 10, 2018.
Second Office Action from Chinese Patent Office dated Jun. 5, 2019.
English Translation of Second Office Action from Chinese Patent Office dated Jun. 5, 2019.
First Office Action from Chinese Patent Office dated Oct. 8, 2018.
English Translation of First Office Action from Chinese Patent Office dated Oct. 8, 2018.
Office Action from Eurasian Patent Office dated Jan. 30, 2019.
English Translation of Office Action from Eurasian Patent Office dated Jan. 30, 2019.

* cited by examiner

Fig. 8a (tecnica nota)

THERMAL SHELL, IN PARTICULAR FOR A BUILDING

The present invention relates to a thermal shell, in particular to a thermal shell for buildings.

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The invention relates to the field of solutions aimed to improve energy efficiency of construction or in general of environments, and more particularly aims to provide a solution, which is inspired by the principle of the thermo-radiating surfaces, modifying it appropriately to allow heating and/or cooling a building with an important saving of energy.

2. Description of Related Art

It is known that, currently, the thermal conditioning of a building or parts of it is delegated to installations of thermal conditioning comprising at least a refrigeration unit, essentially consisting of a refrigeration compressor and an air condenser, which is usually installed outside of the building and which is hydraulically and electrically connected, by means of a hole in the wall which continues into channels, to one or more splitters, ie cooling devices, positioned in internal spaces, within which the evaporation of the cooling fluid occurs, drawing internal air and releasing it treated, so that it can have the desired thermohygrometric characteristics.

This type of system has the disadvantage of generating flows of hot or cold air inside the room to be conditioned, said flows being able to directly hit people stationing in or passing into the environment to be conditioned, often subjecting them to extremes thermal changes that can lead to the onset of colds, joint pain, etc.

To solve this problem systems for thermal conditioning of the radiation type have been proposed, using water (coil tubing), widespread, or infrared (electric heated plates), rarely used, consisting of a radiant panel system that can be placed in the floor, ceiling and, in some cases, even in the wall. Usually, for a best result of temperature conditioning, radiant panels for heating are installed under the floor, while those for cooling are installed on the ceiling. This type of installations, both in heating and cooling cases, is what best approaches to human physiology and thus allows to obtain excellent levels of comfort, as it applies the primary principle of thermo radiance, then working in the field of heat primarily by radiation, with a secondary effect of convection. The phenomenon of convection is present and appreciable, mainly, in the case of vertical internal surfaces, which, during the cold season, tend to warm the air masses at the bottom, next to floors, which, by effect of heating given by the neighboring heat-radiating wall, become hot, losing specific weight and then going up inside the internal environment concerned; arrived at the ceiling, air masses naturally release heat, thus tending to cooling and going back down, thus triggering the well-known principle of natural circulation of air masses, this principle applies also in the case of wall radiators. The same principle of cooling/heating of the air masses in reverse operation will activate in the summer, in the presence of a cold heat-radiating wall, with temperatures lower than the ambient air.

Thermo radiating systems in constructions offer primary advantages, which can be summarized in greater energy efficiency of the system, since they consume less power than convectional systems, thermal comfort, in consideration of the fact that heat distributed on whole surfaces and not of punctual nature is preferable for the human body and his hygrothermic wellness; more efficient system, in terms of size of the external devices of the plants, and works of ordinary and extraordinary maintenance. The thermo radiant systems, in fact, working by radiation, with systems that are little or generally not encumbrant at sight, show clear advantages compared to other systems for the absence of external devices of heat dissipation, which are liable to ordinary cleaning and extraordinary and/or ordinary maintenance.

However, this type of air conditioning system requires extensive renovation works with masonry interventions in the cases in which it has to be applied to existing buildings, or alternatively, when it is desired to avoid renovations choosing a system applicable in coverage on the floor, ceiling or walls, it entails a limitation of space within the building.

BRIEF SUMMARY OF THE INVENTION

In this context is to fit the solution according to the present invention, which aims to provide a thermal conditioning system of buildings that has the purpose of ensuring a faster and more effective, as well as more economical, thermal conditioning of the building, with respect to current systems of thermal conditioning, for the air-conditioning of each room of the building.

These and other results are obtained according to the present invention by proposing a thermal shell for buildings, which can be assimilated to a heat-radiating system for air conditioning/heat and sound insulation of indoor environments for residential/tertiary use and which technically is constituted by a multilayer envelope system formed by three integral elements comprising, respectively, from the outside to the inside: an external perimeter wall/shell, with the function of heat-insulating wall, called the external border; an interspace filled with air to be conditioned; an internal wall/shell, operating as heat-radiating wall, called the internal border. The thermal shell system according to the present invention, also called multi-layer system, defines an interspace to be conditioned confined between the external walls of the building, said interspace being isolated from the surrounding environment external to the building and being used to define a closed circuit for the forced passage of air at a controlled temperature.

The external border of the heat-radiating system acts as an insulating wall, is designed to elevate the thermal inertia of the building concerned, opposes to the transmission outward of flows of hot/cold air generated/released by the interspace. Raising the insulation capability of the external border entails increases in the performance of the heat-radiating system as a whole.

The function of the interspace to be conditioned is that of "heating/cooling element", the interspace can be conditioned through the intake of hot/cold conditioned air, generated with current technologies according to the seasonal demands, through ducts of the system, such as for example supply and return vents of air that is thermally conditioned by a conventional air/air heat pump, included in the interspace to be conditioned or outside it, in adherence or near it. The interspace acts as a closed volume of air that is delimited by the two external/internal borders; it is a closed volume, therefore without air exchange with the outside. In particular, the heat-conditioned air is not in any way intended to inhabited confined environments of the building concerned by the heat-radiating system formed as a result of the thermal shell according to the present invention, but is made solely for the heating/cooling of the internal border, in contact with the confined environments destined to the housing functions, according to the functional type of the case.

In particular, as will be described in greater detail in the following, according to an embodiment of the invention, the interspace can be equipped with an internal diaphragm, aimed at distinguishing two contiguous and communicating air-conditioned rooms, to optimize the natural descending/ascending air flows according to seasonal requirements. The performance of the interspace is not directly related to its thickness and the given size, within certain limits, is not considered vitiating its good functioning.

The internal border that acts as a heat-radiating wall, being contiguous to the conditioned interspace, also exerts a function of insulating system and barrier against the exchange of the flows with the outside, even in case of standstill of the system, or when, once the exercise temperature is reached, the interspace can work at room temperature. Alternatively, according to different embodiments of the solution according to the present invention, the internal border is constituted by the external peripheral wall of an existing building, object of application of the thermal shell of the invention, or is formed from the internal layer of a newly realised system of vertical/horizontal closing.

The object of the present invention is therefore to provide a thermal shell for buildings which allows to overcome the limitations of the thermal conditioning systems according to the prior art and to obtain the technical results previously described.

A further object of the invention is that said thermal shell for buildings can be realized with substantially limited costs, both as regards production costs and as regards operating costs.

Another object of the invention is to propose a thermal shell for buildings which is simple, safe and reliable.

It is therefore a specific object of the present invention a thermal shell for a building, which comprises

- a coating structure disposed around said building, or part of said building, said coating structure comprising, proceeding from the outside towards the inside of the building: a coating, an insulating layer and an interspace; said interspace containing air and forming a closed and isolated room against the surrounding environment;
- means for thermal conditioning of the air contained in said interspace.

Alternatively, according to the invention, said coating structure is constituted by panels applicable to an existing building or panels applicable in the construction of a new building.

Preferably, according to the invention, said panels have a multilayer structure that includes, from the inside towards the outside of the building, a first layer consisting of a cladding, an interspace, an insulating layer and a structural layer.

Alternatively, according to the present invention, said thermoconditioning means can be of the radiating type, or of the type of convection of air and, in the latter case, comprise a suction inlet of air to be conditioned and an output of a forced flow of conditioned air, said input being connectable to the external environment and said outlet being in fluid connection with said interspace; said thermal shell further comprising means for recirculating air from said interspace to said means of thermal conditioning by convection of air; said recirculating means comprising a pipe connected to said input of said means of thermal conditioning.

In particular, always according to the invention, said means of thermal conditioning by convection of air can be chosen from a thermal conditioner, a fan heater, a fan coil or an air conditioner.

Alternatively, always according to the present invention, said means for recirculating air from said interspace to said means of thermal conditioning by convection of air may comprise a perforated pipe and a recirculation conduit or a second interspace, disposed externally with respect to said interspace.

It is evident the effectiveness of the thermal shell for buildings of the present invention, which allows to realize a casing around the building with high thermal inertia, capable of improving the energy efficiency of the building as a whole and, depending on the position of the building, of proving to be capable of supporting or completely replacing any heating and/or cooling system present within it.

BRIEF DESCRIPTION OF THE SEVERAL VIEWS OF THE DRAWINGS

The present invention will be now described, for illustrative but not limitative purposes, according to some of its preferred embodiments, with particular reference to the figures of the accompanying drawings, in which:

FIGS. 8*a* and 8*b* show a schematic diagram representative of the heat flows respectively in the case of thermally conditioned environment by means of air convection and thermally conditioned environment by means of a radiating system, such as that of the present invention.

DETAILED DESCRIPTION OF THE INVENTION

Figure 1:
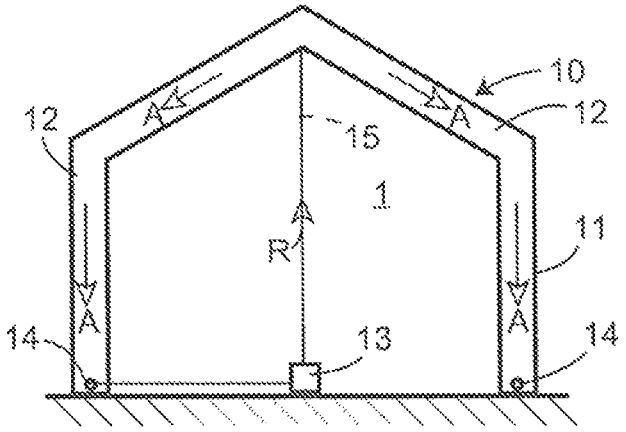
FIG. 1 shows a sectional schematic view of a building to which a thermal shell according to a first embodiment of the present invention is applied.

Looking in more detail to the proposed solution, the thermal shell for buildings according to the present invention can be defined as a multilayer casing to be conditioned, which is distinguished in three sub-systems, respectively from the inside toward the outside: an external border, an interspace to be conditioned and an internal border.

In particular, in the present description, the definition of border identifies a shell portion which may be internal or external with respect to an interspace, inside which is conveyed conditioned air, and which can be constituted by any closed space, horizontal, vertical, or with any inclination, or by any element or perimetral closing system of a building, including the external perimeter walls of the building itself, as well as raised floors or floors endowed with interspace and the flat coverings or coverings provided with flaps, with any geometry and realized with monolayer or multilayer closures, for each material, in any way it is assembled, with techniques in wet (mortar-conglomerates) or dry (in the absence of materials/binders subjected to hardening process by means of contact with the air), and can more generally be extendable to interstorey compartments or portions of it or to continuous wall for multi-storey buildings.

More particularly, the external border of the heat-radiating system that is constituted as a result of the thermal shell for buildings according to the present invention is a wall and/or insulating cover provided with an external cladding, therefore apt to resist to weathering, seasonal temperature variations and day excursions, and to all that can be considered in performance to qualify an external closure. The same external border is designed as a systemic element and, together with the two integrated sub systems, ie the interspace filled with air to be conditioned and internal heat-radiating border/wall, is designed with every type of coating according to the prior art, from the wall of plaster to the continuous, ventilated wall, and flat and pitched roofs. By a systemic definition it is a multilayer air/waterproof closure and is formed by two core layers, from the outside, coating and insulation system, without prejudice to the two above elements, it can be considered as multi-layer package with a plurality of insulating layers and static or ventilated air spaces naturally interposed within the border itself.

The internal border is a wall with heat-radiating function, or destination of reuse, (refunctionalization in case of application on preexisting walls/casings), it is an adjunct to the thermal inertia of the system and represents the vertical/horizontal closing of delimitation of indoor inhabited environments. By definition it is a typical vertical/horizontal closure and is similar for all types of building closure, it can therefore be of mono or multilayer type.

The internal border, heated by convection/conduction on its face delimiting the interspace to be conditioned, will tend to heat up/cool down, and all the heat will be transferred from the border towards the inhabited internal environment by radiation and, to a lesser extent, by convection.

The interspace to be conditioned is instead a closed volume of enclosed air, bordered by the two external/internal borders, without any exchange of air with the outside and the inside, aimed at climate control heating/cooling/dehumidification of indoor environment, via the internal border with heat-radiating function, devoid of elements for the exchange of air with the external environment or with the inside of the building, capable of interfacing with each air conditioning system, or by means of simple opening on the border of vents for releasing and collecting forced air, or able to accommodate temperature control means of the radiant type, with any geometry shape compatible with the size of the interspace in question. The air conditioning of the interspace is obtainable, according to the present invention, with any system and technology of the prior art, and, according to one exemplary but not limitative embodiment of the present invention, with vents/channels for the intake of air, given by current technology in heat pump.

The operation of the system of the invention provides for the release of hot/cold forced-air, according to seasonal requirements, the air being able to be heat-treated with any technology, as an example being considered a treatment of the air destined to the interspace to be conditioned by means of heat pump, inside the interspace to be conditioned. The latter, having reached the necessary temperature, deduced from the calculation of energy requirements, tends to transmit heat towards the internal wall/border that behaves as a heat-radiating wall, able to bring the temperature of the internal environments to the desired operating temperature.

The thermal shell for buildings according to the present invention allows, therefore, an air-conditioning of the internal environments by means of heating/cooling, mainly by radiation and by induced convection, and, simultaneously, the system, with the predisposition of an external wall/border, positioned over the perimetral conventional wall/cover of the building, tends to increase the thermal inertia of the whole building.

The air thermoconditioning system can be supplementary or replace any existing systems in the building, or can be applied in the realising of new buildings, and is also interfaced with technologies for the production of renewable energy (such as photovoltaic, microelolic, etc).

In temperature conditions different from the one considered ideal and determined in advance at the design stage, (normally equal to 20/22° C.), compared with a lower (winter season) or higher (summer season) temperature difference, the air thermal-conditioning unit intervenes, producing and entering hot/cold air inside the interspace, with an operating temperature that can determine the passive activation, for simple conduction/convection, of the internal border. By contact with living spaces, the internal border, because of the different temperature of the interspace, will act as a heat-radiating plate, releasing heat or cold, by irradiation, to the inhabited internal environment, until it reaches the desired operating temperature or project, if operated by temperature sensors. Upon reaching the operating temperature, the capacity of inertia of the system keeps the temperature up to a minimum threshold value, below which reactivates the air thermal-conditioning unit.

Figure 2:
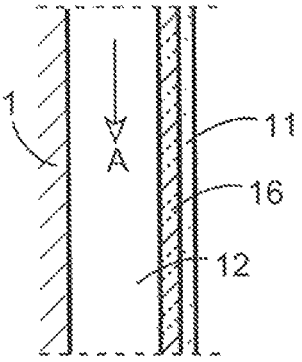
FIG. 2 shows a sectional schematic view of a portion of the thermal shell of FIG. 1.

Referring preliminarily to FIGS. 1 and 2, a thermal shell according to a first embodiment of the present invention consists of a covering structure, generally designated by the reference numeral 10 which completely covers a building 1 and which includes a coating 11 defining a interspace 12 between the building and the first coating 11, said space being closed with respect to the external environment. In the interspace 12, along the direction of flow A, the forced passage of air takes place at a controlled temperature, coming from a thermal conditioner 13 (such as a fan heater, a fan coil or an air conditioner), arranged at the top of the building 1, at least partially inside the interspace 12. Said air at a controlled temperature is collected by a manifold 14 arranged at the base of the building 1, inside the interspace 12. By way of example, said manifold 14 may be a perforated pipe. The air collected from the manifold 14 is then recirculated to the thermal conditioner 13 by means of a recirculation duct 15, along the direction of flow R. The circulation of air that is established inside the covering structure 10 can be closed or a certain amount of air can be taken from the outside, for example from the air thermal conditioner 13.

With particular reference to FIG. 2, it is evident that, for the correct operation of the thermal shell of the present invention, maximum heat exchange between the building 1 and the air at a controlled temperature flowing through the interspace 12 will have to be ensured. Consequently, unlike the systems of ventilated wall, in the thermal shell according to the present invention, the insulating layer 16 does not separate the space 12 from the building 1, but rather by the coating 11 and, at the same time, from the external environment. The insulating layer 16 can then be applied directly on the side facing the interspace 12 of the coating 11. Both the insulating layer 16 and the coating 11 are supported by a support system connected to the facade of the building, according to the same methods already applied for the support of ventilated walls of the known type.

Alternatively, with respect to the solution shown with reference to FIG. 1, it is possible to have the thermal conditioner 13 to the base of the building 1 and the covering structure 10 and the manifold 14 at its top.

Figure 3:
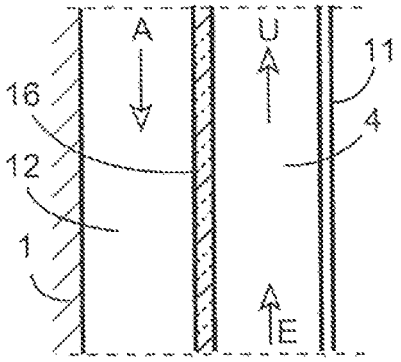
FIG. 3 shows a sectional schematic view of a portion of a thermal shell according to a second embodiment of the present invention.
Figure 4:
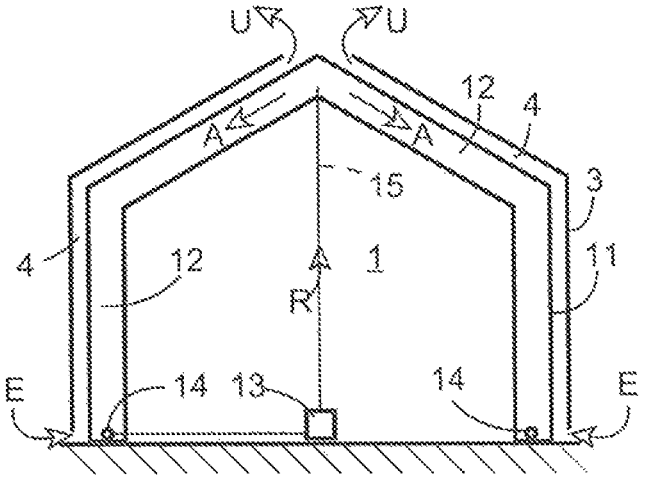
FIG. 4 shows a sectional schematic view of a building to which the thermal shell of FIG. 3 is applied.

Referring to FIGS. 3 and 4 is shown a second embodiment according to the present invention, in which the building 1 to which the thermal shell of the present invention is applied is further coated with a ventilated wall. In this embodiment, the insulating layer 16 which separates the interspace 12 from the outside, is not applied directly to the coating 11, but between the two is left a space for a second interspace 4, provided with openings 5 arranged at the base and openings 6 arranged at the top of the building 1, in order to activate, by "chimney effect", an efficient natural ventilation. For the rest, the thermal conditioner 13 and the manifold 14 operate exactly as shown with reference to FIGS. 1 and 2. Also in this case, the support system of the shell is of the same type as that already commonly used for ventilated walls according to known technique.

Figure 5:
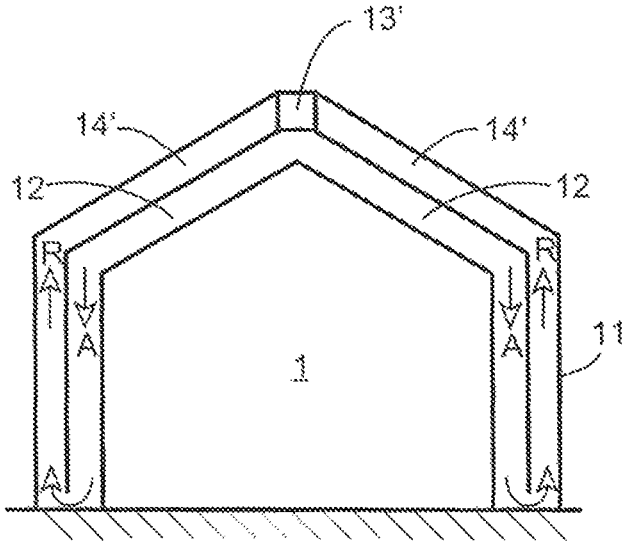
FIG. 5 shows a sectional schematic view of a building to which a thermal shell according to a third embodiment of the present invention is applied.

FIG. 5 shows a third embodiment of the thermal shell for buildings according to the present invention, in which a double interspace is defined around the building 1, a first interspace 12 for the forward flow A of air at a controlled temperature coming from the thermal conditioner 13' and a second interspace 14' for the return flow R of air. The two interspaces are separated by a panel 11' along the whole path around the building 1, and are connected only in correspondence of the thermal conditioner 13', at the top of the building 1 and of an opening at the base of the building 1 (alternatively the thermal conditioner can be placed at the base of the building and opening communication between the first interspace 12 and the second interspace 14' is consequently placed at the top). The thermal shell according to this further embodiment of the present invention, anyway, defines a closed system compared to the outside, due to the provision of the coating 11 for the closing of the interspace 14'. The insulating layer 16 is conveniently applied directly on the side facing the interspace 14' of the coating 11. All of the panel 11' of separation between the interspace 12 for the forward flow A and the air interspace 14' for return flow R of the air, and the insulating layer 16, and the coating 11 are provided with a support system connected to the facade of the building, according to the same methods already applied for the support of ventilated walls of the known type.

Figure 6:
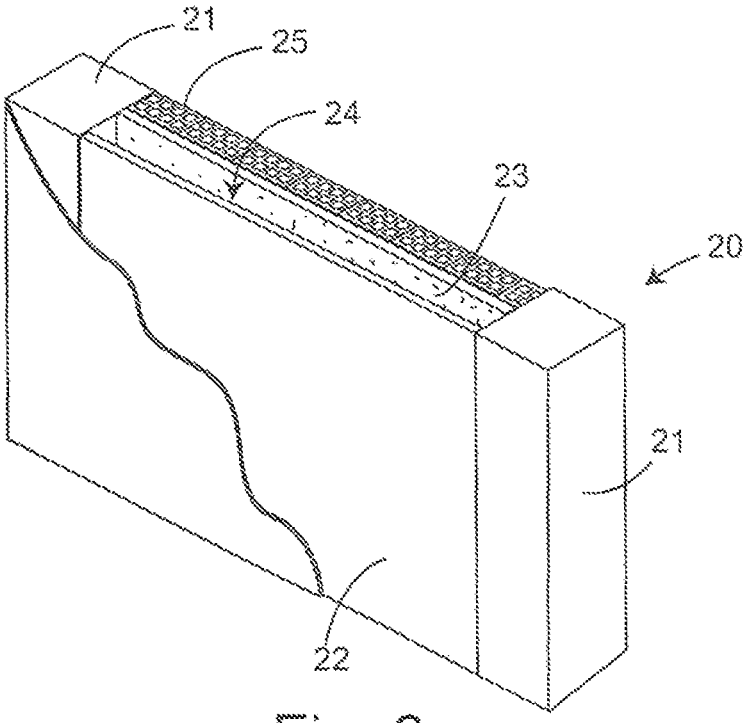
FIG. 6 shows a perspective view of a prefabricated panel incorporating a thermal shell according to a fourth embodiment of the present invention.

Finally, with reference to FIG. 6, a further embodiment of the present invention is shown, which is preferred with respect to those above in all cases where the thermal shell for buildings according to the present invention does not apply to existing buildings, but rather new buildings are built where the thermal shell can be incorporated, thus becoming a part of the structure.

According to this embodiment it is proposed to form the external walls of the building with a structure of successive layers which provides, proceeding from the inside to the outside of the building, a first layer consisting of a heat-radiating wall 22, an interspace 23 for the passage of forced air at a controlled temperature, an insulating layer 24 and a structural layer 25, made for example of perforated bricks of the pots type. Conveniently, it is possible to realize this type of structure by making use of prefabricated elements 20, in which the layers previously said are enclosed laterally between two support pillars 21.

Obviously, also in the case of new buildings where the thermal shell of the present invention can be incorporated becoming a part of the structure it is possible to provide alternative embodiments, of the same type as those previously described with reference to FIGS. 3 and 4 and to FIG. 5, with simple modifications of the layered structure already described with reference to FIG. 6.

The advantages of the thermal shell for buildings according to the present invention are evident, the shell constituting a complete innovation from the energy saving point of view, as regards the building system. In its implementation, in fact, the thermal shell according to the present invention involves an original and scientifically validated solution, as will be specified hereinafter, to meet the energy needs of a building, or a building unit (or a plurality of buildings/units) for the conduct of business in the comfort and well-being.

The thermal shell for buildings according to the present invention allows, in fact, to provide energy to the building not directly, through the air conditioning of the air volumes contained in it, but in an indirect way, by inducing of an amount of heat, taking advantage of an interspace to be conditioned, specifically dimensioned and made, as a carrier of the same amount of heat.

The invention will be further described in the following for illustrative but not limitative aims, with particular reference to some illustrative examples, in which the following premises must be taken into account.

In order to demonstrate the advantages of the thermal shell for buildings according to the present invention, to the present description are attached some analysis of a model type of thermal shell system.

The model was created in a digital simulator and made explicit with data that conforms to real application.

The data obtained from the virtual model have scientifically demonstrated the effectiveness of the thermal shell for buildings according to the present invention, with respect to the analyses conducted in terms of energy efficiency of a wall made with the thermal shell, in absolute terms and in relative terms when compared with walls similar to those assumed by the calculation that are not equipped with thermal shell.

The analysis was conducted on a virtual model of confinement geometry of form similar to a residential unit/office type.

The calculation model is based on the study of the stratigraphic units type of the external vertical closings assimilable to the thermal shell for buildings according to the present invention, and then a comparative analysis of the calculation model developed with some types of mono and multilayer walls belonging to current building types.

The analysis considered three types of perimeter walls, with different thicknesses, building system and materials, and also considered as borderline cases, distinguishing walls with high specific weight (in solid masonry walls), low density (walls sandwich lightweight insulating). The obtained data have revealed a highly significant savings in the case of continuous solid brick masonry, with and without the system, highlighting savings, calculated for thermal power unitary (in watts), equal to almost 60% of saving, thus passing to an estimated savings of approximately 40% for masonry cassette, and then to a saving for the walls sandwiched with light insulating panels of about 15%.

From the thermo-technical point of view, to define the parameters of the project that aim to balance the system to satisfy the thermal needs, it is possible to set first the physical phenomenon at the basis of the exchange of heat flows between internal and external space.

The first phase is finalized to the identification of requirements for the air conditioning of the building/building unit of reference; these needs depends on a number of boundary conditions regarding: the geometry of the building/unit and the human activities carried out inside it; standardized data and external climatic conditions; the thermal environment in which the building/unit falls with reference to units and/or neighboring buildings; and more.

Once the requirements are known, it is possible to tune the energy balance, defining the amount of heat to be exchanged with the unit and with the external environment, to ensure the full balance between inflows and outflows.

It is a distinctive and dominant element in the balance the inclusion (in winter conditions) and removal (in summer mode) of the amount of heat through the gap: the arrangements for delivery or removal of energy through volumes of air in motion complicates, in fact, the technical problem and it is therefore necessary to conduct a fluid-thermo-dynamics, adapted to define the coefficients of heat exchange between the interspace and adjacent rooms, such as the building/reference unit and the outside.

Upon completion of the heat balance, it is possible to consider the plant system for the definition of the complex constituted by the building and heat from the casing of the invention, and assess the complex of primary energy to support their operation.

The setting of calculation has been defined in full compliance with the technical standards referred to by the legislation on reducing energy consumption in buildings, both with regard to the data and input parameters in both prediction and analysis procedures that, in retrospect, will conducted on an ad hoc basis.

It proceeded at first with the calculation of the needs and the balance of heat flows, with the aim to evaluate the goodness of the system from the point of view of the containment of the thermal and convenience in comparison with traditional systems.

The evaluation to determine the energy requirement of the building envelope and, as already mentioned, has developed from predetermined parameters, relatively, first of all, the climatic conditions and geometric.

Figure 7:
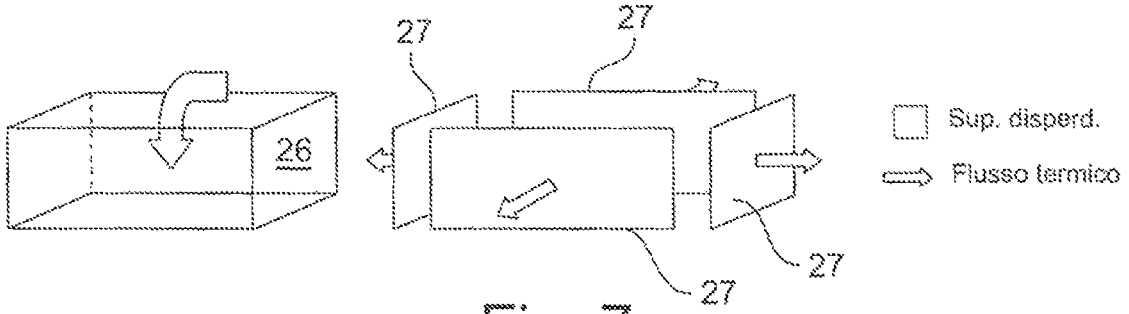
FIG. 7 shows a schematic diagram representative of a unit type considered for the evaluations of Examples 6.1-6.6.

Making a preliminary reference to FIG. 7, it is considered, in the first instance, a unit type 26 consists of a plan surface of 100 square meters and a height of 3 meters, with dispersing surface equal to 120 square meters, which represents the sum of four side walls 27, imagining that there are other units/buildings bordering conditioned only on the floor below and the floor above.

The analysis of the flows through the building envelope has been conducted, according to thermodynamic theory, for one-way street and observing a sample of the wall dispersant; has therefore been examined a representative portion of the wall and dispersing in it have been identified the heat flows in input and output.

The thermal shell, in this case, consists of a complex stratigraphy, determined by an external border, to be conditioned interspace and an internal border.

The external border is a closed casing with function of thermal insulation system. Thickness, materials and their nature are counted when calculating a function of energy requirements and performance of the project.

The interspace to be conditioned is a sealed space, interposed between the two boundaries, within which is present a layer of air (which can be static or in motion, as will be better explained hereinafter), which constitutes the element stratigraphic essential of the solution according to the present invention: it is a hollow space, of a thickness gross suitably dimensioned according to the project data, which constitutes the physical vehicle for the placing/heat extraction. The air interspace, brought to the temperature of calculation, is able, by convection, to transform the internal border, in contact with the confined environment to be conditioned, in a heat-radiating wall.

The internal border is the perimeter wall of the casing heat the invention which is to be in contact with the environments of the building to be air conditioned. In the case of new construction, the internal border may be the subject of calculation of optimum dimensioning, as well as the external border. In case of application of the solution according to the present invention to an existing building, the optimum degree of insulation is determined by acting on the external border, without affecting the general operation of the thermal shell of the invention.

Figure 8B:
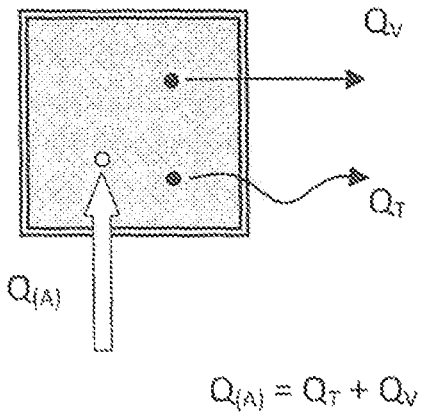
Figure 8B:
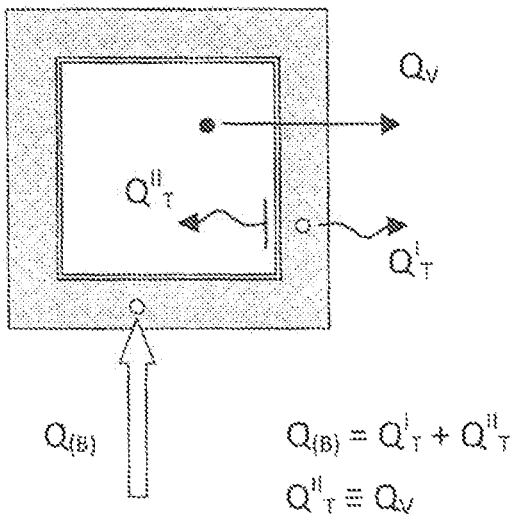

For the calculation of thermal needs is possible, with good approximation, consider the predominant rates, which in this case are formed by the thermal power exchanged for transmission (ΣQT) and ventilation (ΣQV) (schematized in FIG. 8*b* and, for comparison with the technique Note, in FIG. 8*a*); it is necessary to remark, in this regard, that the air exchange is necessary and obligatory whatever the 'human activity carried out within the environment and considered that, if example, is calculated with reference to a habitable environment generic (UNI 12831) with minimal natural air flow rate of 0.5 volumes/hour.

It is considered, for the winter operation, a generalized condition refers to the external climate, prefixing an external temperature of 0° C. and an ambient temperature of project equal to 20° C.

In summary we can be given here the input data used for the calculation model:

Climatic data:

Outside temperature: 0° C.

Internal temperature: 20° C.

Relative humidity: ref. UNI

Geometric data:

Floor area: 100 $m^2$

Gross height: 3 m

The volume to be conditioned: 300 $m^2$

Dispersing surface: 120 $m^2$

With regard to thermal power for transmission on the data described above, are calculated the transmittance of the three stratigraphy in question, considering the material properties of the project and the transfer coefficients (adductances) provided for in the technical standards UNI, for both internal and external environments.

The calculation is conducted for each stratigraphy relative to the solution suggested according to the present invention and for other packages stratigraphic configurations related to buildings of the traditional type. The comparison between the stratigraphy allows to evaluate the convenience of the solution of the invention in terms of the casing and requirement of the building.

Tabs that follow the data thermo-hygrometric stratigraphy used for the calculation of the needs and budgets of heat flows.

Example 1

Characteristics of the External Border

Figure 9:
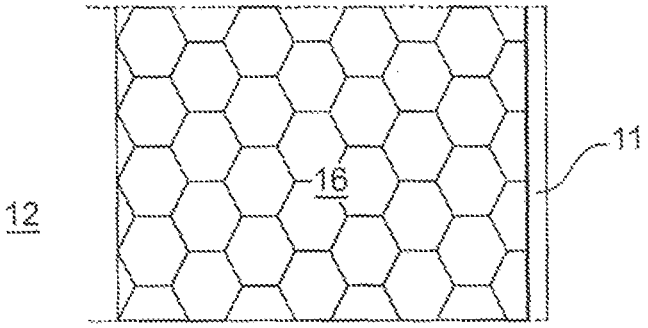
FIG. 9 shows a sectional view of a thermal shell according to one embodiment of the present invention, considered in Examples 1, 6.2, 6.4 and 6.6.

Referring to FIG. 9, the external border considered in the analysis conducted to assess the effectiveness of the solution of the invention is composed of a cover 11 made of plastic plaster to coat and by an insulating layer 16 of expanded polystyrene (EPS). The figure also shows the interspace 12.

The thermal properties are measured according to the UNI EN ISO 6946 and are summarized in the following tables.

TABLE 1

Characteristics of the overall external border

| | |
|---|---|
| Typology | Wall |
| Disposition | Vertical |
| Direction | External |
| Thickness | 103.0 mm |
| Transmittance U | 0.344 W/($m^2$K) |
| Resistance R | 2,906 ($m^2$K)/W |
| Surface mass | 4 kg/$m^2$ |
| Color | Clear |
| Area | 1 $m^2$ |

TABLE 2

Stratigraphy of the external border

| Layer | Thickness s [Mm] | Conductivity Λ [W/(mK)] | Resistance R [($m^2$K)/W] | Density P [Kg/$m^3$] | Therm capacity. C [KJ/(kgK)] | Ratio $M_a$ | Ratio $M_u$ |
|---|---|---|---|---|---|---|---|
| EPS polystyrene panel | 100.0 | 0.035 | 2.857 | 35 | 1.45 | 50.0 | 50.0 |
| Plastic plaster to coat | 3.0 | 0.330 | 0.009 | 1.300 | 0.84 | 32.0 | 32.0 |
| external adductance (horizontal flow) | — | — | 0.040 | — | — | — | — |
| TOTAL | 103.0 | | 2.906 | | | | |

Unitary conductance Internal surface: 0.000 W/(m$^2$K)
Unit resistance Internal surface: 0.000 (m$^2$K)/W
Conductance unit External surface: 25,000 W/(m$^2$K)
Unit resistance External surface: 0.040 (m$^2$K)/W Example 2

Features of the Internal Border. Solid Brick Wall

Figure 10:
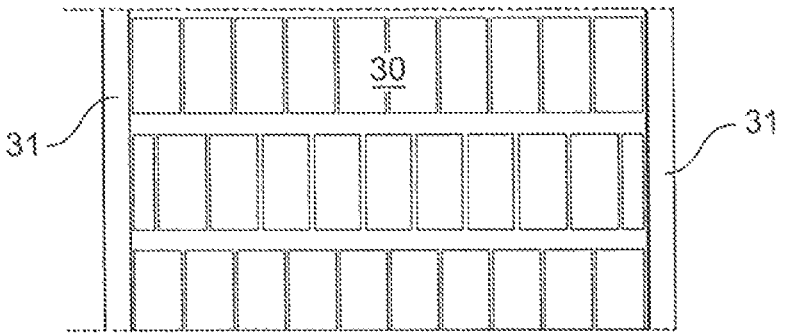
FIG. 10 shows a sectional view of a wall with masonry bricks, considered in the examples 2, 6.1 and 6.2.

In the analysis conducted to assess the effectiveness of the solution of the invention it has been taken into account different types of internal border. According to a first type, which relate to FIG. 10 and the present example, the internal border is constituted by a wall 30 of solid brick coated with plaster 31 on both sides, the thermal properties of which were evaluated according to UNI EN ISO 6946 and are summarized in the following tables.

TABLE 3

| Characteristics of the overall internal border (case in solid brick wall) | |
|---|---|
| Typology | Wall |
| Disposition | Vertical |
| Direction | External |
| Thickness | 440.0 mm |
| Transmittance U | 1.617 W/(m$^2$K) |
| Resistance R | 0.619 (m$^2$K)/W |
| Surface mass | 800 kg/m$^2$ |
| Color | Clear |
| Area | 1 m$^2$ |

TABLE 4

Stratigraphy of internal border (solid brick wall)

| Layer | Thickness s [mm] | Conductivity Λ [W/(mK)] | Resistance R [(m$^2$K)/W] | Density P [Kg/m$^3$] | Therm capacity. C [kJ/(kgK)] | Ratio $\mu_a$ | Ratio $\mu_u$ |
|---|---|---|---|---|---|---|---|
| Internal adductance (horizontal flow) | — | — | 0.130 | — | — | — | — |
| Internal plaster | 20.0 | 0.580 | 0.034 | 1200 | 0.91 | 3.20 | 3.20 |
| Solid brick laying outside | 400.0 | 1.054 | 0.380 | 2000 | 0.84 | 10.7 | 10.7 |
| External plaster | 20.0 | 0.580 | 0.034 | 1200 | 0.91 | 3.20 | 3.20 |
| External adductance (horizontal flow) | — | — | 0.040 | — | — | — | — |
| TOTAL | 440.0 | | 0.619 | | | | |

Unitary conductance Internal surface: 7,690 W/(m$^2$K)
Unit resistance Internal surface: 0.130 (m$^2$K)/W
Conductance unit External surface: 25,000 W/(m$^2$K)
Unit resistance External surface: 0.040 (m$^2$K)/W Example 3

Characteristics of the Internal Border. Wall Cassette

Figure 11:
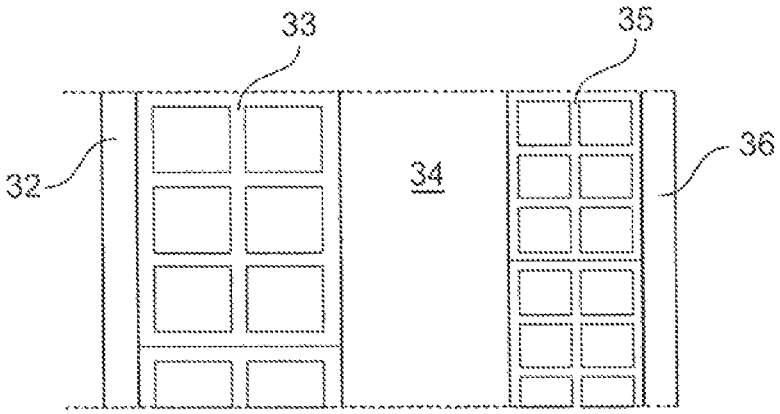
FIG. 11 shows a sectional view of a wall with masonry cassette, considered in the examples 3, 6.3 and 6.4.

In accordance with a second type of internal border, referred to in FIG. 11 and the present example, it is considered to be a wall in the cassette, consisting of the following layers, proceeding from the inside to the outside: 32 internal plaster, brick 33 drilled 120×250 mm (with mortar joints of 5 mm), hollow space 34 of air of 100 mm thick, perforated brick 35 80×250 mm (with mortar joints of 5 mm), external plaster 36.

The thermal properties of the internal border have been evaluated according to the UNI EN ISO 6946 and are summarized in the following tables.

TABLE 5

| Characteristics of the overall internal border (wall cassette) | |
|---|---|
| Typology | Wall |
| Disposition | Vertical |
| Direction | Out |
| Thickness | 340.0 mm |
| Transmittance U | 1,022 W/(m$^2$K) |
| Resistance R | 0.979 (m$^2$K)/W |

TABLE 5-continued

| Characteristics of the overall internal border (wall cassette) | |
|---|---|
| Surface mass | 360 kg/m$^2$ |
| Color | Clear |
| Area | 1 m$^2$ |

insulating wall light, it consists of the following layers, proceeding from the inside to the outside: 37 internal plaster, plasterboard internal 38 plates, 39 wood-fiber panel, plasterboard 40 external plates, 41 external plaster.

The thermal properties of the internal border are summarized in the following tables.

TABLE 6

Stratigraphy the internal border (wall cassette)

| Layer | Thickness s [mm] | Conductivity Λ [VW(mK)] | Resistance R [(m$^2$K)/W] | Density P [Kg/m$^3$ ] | Term capacity. C [KJ/(kgK)] | Factor μ in | Factor $M_u$ |
|---|---|---|---|---|---|---|---|
| Internal adductance (horizontal flow) | — | — | 0.130 | — | — | — | — |
| Internal plaster | 20.0 | 0.580 | 0.034 | 1200 | 0.91 | 3.2 | 3.2 |
| Hollow brick internal | 120.0 | 0.352 | 0.341 | 1800 | 1.00 | 10.0 | 5.0 |
| Air | 100.0 | 0.560 | 0.179 | 1 | 1.00 | 1.0 | 1.0 |
| Hollow brick internal | 80.0 | 0.364 | 0.220 | 1800 | 1.00 | 10.0 | 5.0 |
| External plaster | 20.0 | 0.580 | 0.034 | 1200 | 0.91 | 3.2 | 3.2 |
| External adductance (horizontal flow) | — | — | 0.040 | — | — | — | — |
| TOTAL | 340.0 | | 0.979 | | | | |

Unitary conductance Internal surface: 7,690 W/(m$^2$K)

Unit resistance Internal surface: 0.130 (m$^2$K)/W

Conductance unit External surface: 25,000 W/(m$^2$K)

Unit resistance External surface: 0.040 (m$^2$K)/W

Example 4

Characteristics of the Internal Border. Light Wall Insulation

Figure 12:
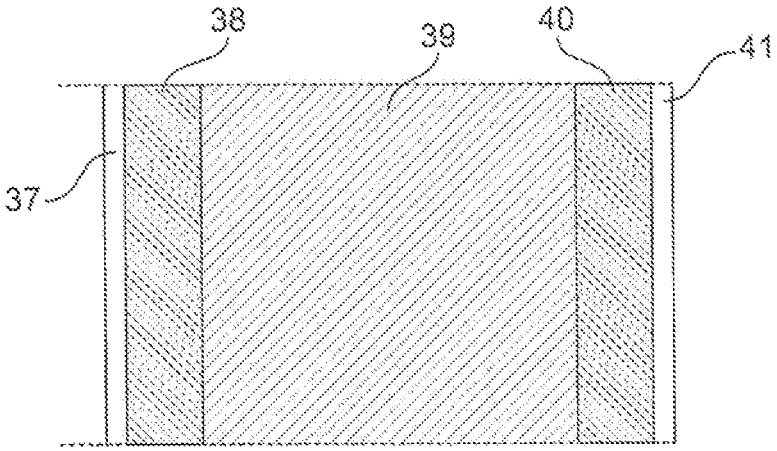
FIG. 12 shows a sectional view of a light insulating wall, considered in Examples 4, 6.5 and 6.6.

According to a third type of internal border, they refer to FIG. 12 and the present example, it is considered to be an

TABLE 7

| Characteristics of the overall internal border (light wall insulation) | |
|---|---|
| Typology | Wall |
| Disposal | Vertical |
| To | External |
| Thickness | 92.0 mm |
| Transmittance U | 0.643 W/(m2K) |
| Resistance R | 1,554 (m$^2$K)/W |
| Surface mass | 33 kg/m$^2$ |
| Color | Clear |
| Area considered | 1 m$^2$ |

TABLE 8

Stratigraphy the internal border (light wall insulation)

| Layer | Thickness s [mm] | Conductivity Λ [W/(mK)] | Resistance R [(m$^2$K)/W] | Density P [Kg/m$^3$ ] | Term capacity C [KJ/(kgK)] | Factor μ in | Factor $M_u$ |
|---|---|---|---|---|---|---|---|
| Internal adductance (horizontal flow) | — | — | 0.130 | — | — | — | — |
| Internal plaster | 3.0 | 0.580 | 0.005 | 1200 | 0.91 | 3.2 | 3.2 |
| Internal drywall | 13.0 | 0.210 | 0.062 | 900 | 1.30 | 8.7 | 8.7 |
| Fiberboard | 60.0 | 0.048 | 1.250 | 160 | 2.10 | 5.0 | 5.0 |
| Plasterboard external | 13.0 | 0.210 | 0.062 | 900 | 1.30 | 8.7 | 8.7 |
| External plaster | 3.0 | 0.580 | 0.005 | 1200 | 0.91 | 3.2 | 3.2 |

TABLE 8-continued

| Stratigraphy the internal border (light wall insulation) | | | | | | | |
|---|---|---|---|---|---|---|---|
| Layer | Thickness s [mm] | Conductivity Λ [W/(mK)] | Resistance R [(m²K)/W] | Density P [Kg/m³ ] | Term capacity C [KJ/(kgK)] | Factor μ in | Factor $M_u$ |
| External adductance (horizontal flow) | — | — | 0.040 | — | — | — | — |
| TOTAL | 92.0 | | 1.554 | | | | |

Unitary conductance Internal surface: 7,690 W/(m²K)
Unit resistance Internal surface: 0.130 (m²K)/W
Conductance unit External surface: 25,000 W/(m²K)
Unit resistance External surface: 0.040 (m²K)/W

Example 5

Characteristics of the Calculation Model Used Kinematic

For the determination of the coefficients of exchange within the interspace, however, it was used to dealing with theoretical and empirical, based on laboratory experiments, provided functional relationships conducive to a settlement of the case in Pravachol.

Figure 13:
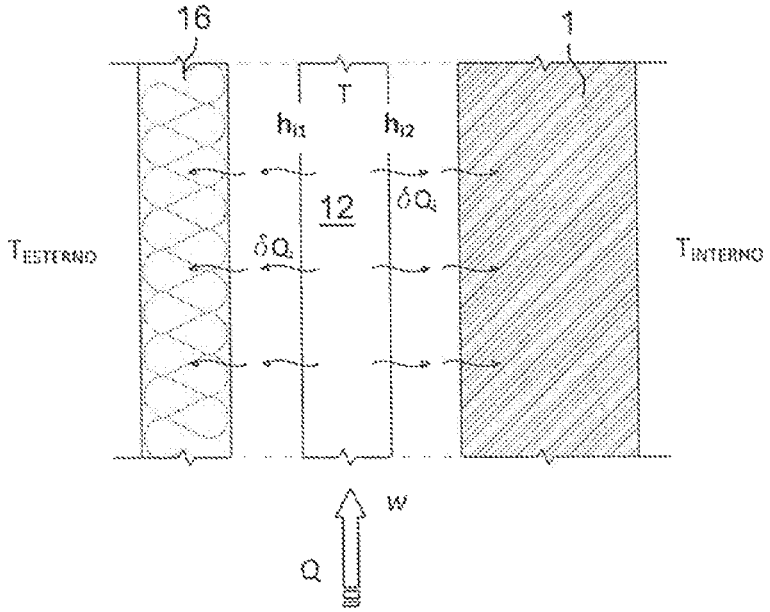
FIG. 13 shows the geometric pattern of the two-dimensional model of kinematic calculation adopted for the simulation of the thermal shell according to the present invention.

In particular, it has been set to a two-dimensional model of kinematic calculation, adherent to the geometric reality of the wall to the thermal shell according to the present invention and shown schematically in FIG. 13, which has considered all the parameters related to forced convection in the air interspace, such as: velocity of the fluid, motion of the fluid, velocity boundary layer, kinematic viscosity, conductivity of the fluid, dimensionless parameters Reynolds, Nusselt, Prandtl, etc.; as well as: size of the duct, equivalent diameter, exchange surfaces.

In cases of the speed w of the fluid inside the interspace equal to 1 m/s, the elaborations on the system of heat exchange by forced convection lead to the determination of the coefficients of heat exchange, expressed in [W/m²K], respectively on the external side of the interspace ($h_{int.1}$) and on the external side of the interspace ($h_{int.2}$).

Table 9 below shows the calculation data input and the values of the convective heat transfer coefficients in output.

TABLE 9

| | DT1 | DT2 |
|---|---|---|
| Outside temperature ($T_{est}$) (° C.) | 0 | 20 |
| Internal temperature ($T_{interc.}$) (° C.) | 25 | 25 |
| Average temperature ($T_{med.}$) (° C.) | 12.5 | 22.5 |
| Air velocity undisturbed (W_) (m/s) | 1 | 1 |
| Kinematic viscosity ($n_{Tmed}$) (m²/s) | 1.46E−05 | 1.55E−05 |
| Prandtl number (Pr) (—) | 0.71613 | 0.71465 |
| Thickness interspace ($s_{interc}$) (m) | 0.10 | 0.10 |
| Height interspace ($in_{interc}$) (m) | 3 | 3 |
| Area interspace (A) (m²) | 0.3 | 0.3 |
| Intercape dine perimeter (P) (m) | 6.2 | 6.2 |
| Equivalent diameter ($D_{eq}$) (m) | 0.19 | 0.19 |
| Reynolds number (Re) (—) | 13266 | 12460 |
| Flow regime | Turbulent | turbulent |
| Nusselt number (Nu) (—) | 87.48 | 87.72 |

TABLE 9-continued

| | DT1 | DT2 |
|---|---|---|
| Nusselt number (Nu) (—) | 41.35 | 39.30 |
| Conductivity of the air (the$_{air}$) (W/mK) | 0.02509 | 0.02584 |
| Coefficient of heat exchange of the air ($h_{int1}$(W/m²K)) | 11.3 | 11.0 |

Example 6

Results

The processing carried out by the method described above and with the data cited produces interesting results and appreciable in absolute numbers.

In addition it is possible to compare the results obtained for the "wall thermal shell" with those obtained with convectional casings (ie infill traditionally made in construction).

In the examples that follow they are shown the report calculation.

6.1 Example of Comparison

Traditional Wall with Solid Brick Wall

Figure 14A:
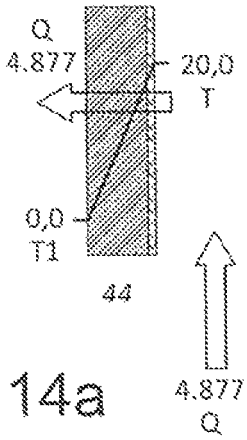
FIG. 14*a* shows a diagram of the heat flows and of the temperature along the wall thickness of Example 6.1.
Figure 14B:
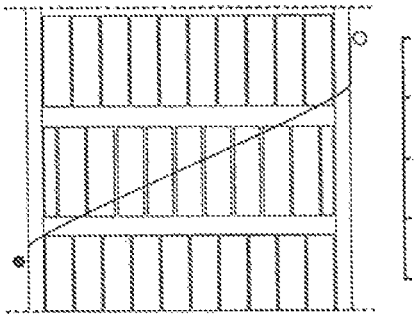
FIG. 14*b* shows a diagram of the temperature curve along the wall thickness of Example 6.1.

Referring to FIGS. 14*a* and 14*b*, in the case of a wall of solid bricks, with the following properties:

floor area: 100 m²
Volume: 300 m²
supe rficie available: 120 m²
K1: 1.62 W/m²K
S1: 120.0 m²
T: 20.0° C.
T1: 0.0 heat flowes are the following:

Q: 3877.2 W
Qv: 1000 W
$Q_{tot}$: 4877.2 W from which, the report:

$$K_t=1/R_t$$

with $$R_t=1/h_{int}+\Sigma(s_t/\lambda_t)+1/h_{and}$$

where $h_{int}$=7.7 W/m²K, $s_t$=0.44 m, $H_{and}$=25 W/m²K

It allows to obtain:

R=0.62 m²K/W
K1=1.62 W/m²K

Example 6.2

Wall with Thermal Shell of Solid Brick Wall

Figure 15A:
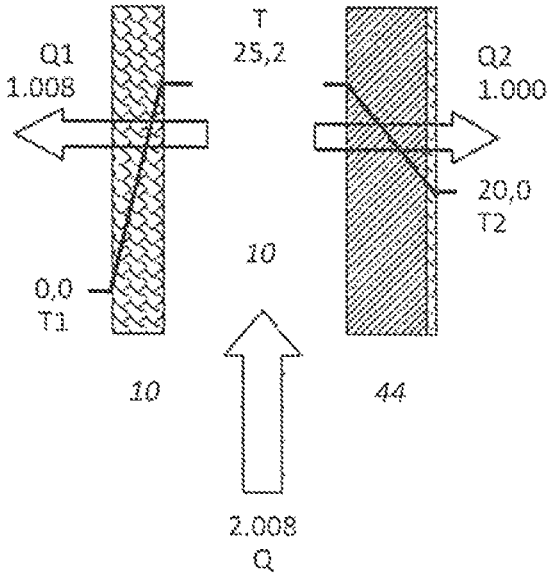
FIG. 15*a* shows a diagram of the heat flow and of the temperature along the thickness of the internal border (wall) and of the external border (coating of the invention) in Example 6.2.
Figure 15B:
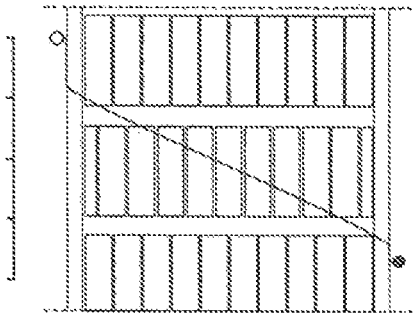
FIG. 15*b* shows a diagram of the temperature curve along the wall thickness of Example 6.2.

Referring to FIGS. 15*a* and 15*b*, in the case of bricks in a wall filled with insulating shell according to the present invention, with still air inside the interspace, given the following properties:

floor area: 100 $m^2$
Volume: 300 $m^2$
available surface: 120 $m^2$
K1: 0.33 $W/m^2K$
K2: 1.62 $W/m^2K$
T1=0.0° C. S1: 120.0 $m^2$
T2: 20.0° C. S2: 120.0 $m^2$ heat flowes are the following:

Q1: 1008 W
Q2: 1000 W
Q: 2008 W
T: 25.2° C.
K1S1: 40.1 W/K
K2S2: 193.9
T1-T2=−20.0° C.

Q2=Qv2

$\rho$=1.2 $kg/m^2$
cP=1000 J/kgK
T=20.0° C.
V=300 $m^2$
n=0.5 h
Hv=50 W/K
Qv=1000 W from which, via the same relationship of Example 6. 1:

for ΔT1 outwards, with the front heated, you $h_{int}$=11.3 $W/m^2K$, $s_1$=0.10 m, $\lambda_1$=0.35 W/mK; $R_1$=2.86 $m^2K/W$, $s_2$=0.003 m, $\lambda_2$=0.330 W/mK; $R_2$=0.01 $M^2K/W$, $H_{and}$=25 $W/m^2K$;

R=2.99 $m^2K/W$
K1=0.33 $W/m^2K$ and for ΔT2 towards the internal environment of the wall brick pi eni has $h_{int}$=11.0 $W/m^2K$, $s_1$=0.44 m, $H_{and}$=7.7 $W/m^2K$;

R=0.62 $m^2K/W$
K2=1.62 $W/m^2K$

Example 6.3

Comparison. Traditional Masonry Wall with Cassette

Figure 16A:
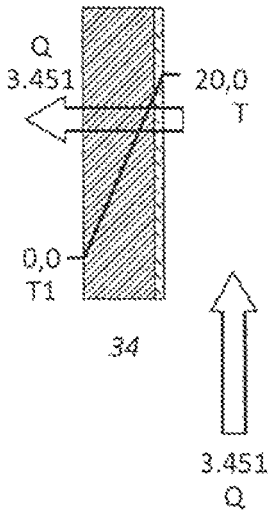
FIG. 16*a* shows a diagram of the flows of heat and of the temperature along the wall thickness of Example 6.3.
Figure 16B:
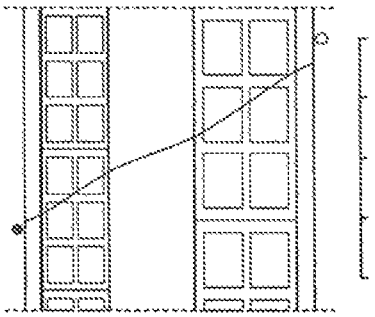
FIG. 16*b* shows a diagram of the temperature curve along the wall thickness of Example 6.3.

Referring to FIGS. 16*a* and 16*b*, in the case of convectional wall with masonry cassette, with the following properties:

floor area: 100 $m^2$
Volume: 300 $m^2$
available surface: 120 $m^2$
K1: 1.02 $W/m^2K$
S1: 120.0 $m^2$
T: 20.0° C.
T1: 0.0 heat flowes are the following:

Q: 2451.5 W
Qv: 1000 W
$Q_{tot}$: 3451.5 W from which, the report:

$$K_t=1/R_t$$

with $$R_t=1/h_{int}+\Sigma(s_t/\lambda_t)+1/h_{and}$$

where $h_{int}$=7.7 $W/m^2K$, $s_1$=0.34 m, $H_{and}$=25 $W/m^2K$

It allows to obtain:

R=0.98 $m^2K/W$
K1=1.02 $W/m^2K$

Example 6.4

Wall with Thermal Shell of Traditional Masonry Cassette

Figure 17A:
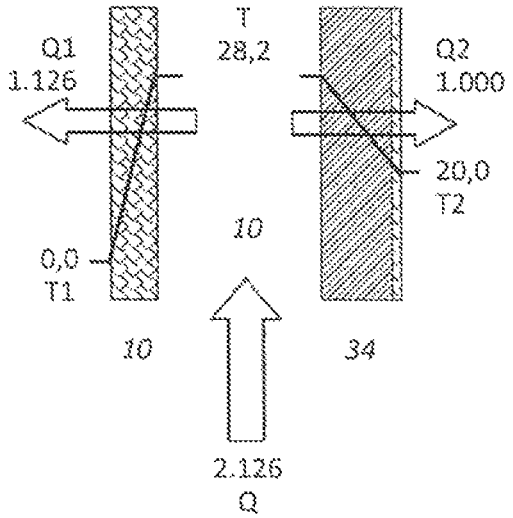
FIG. 17*a* shows a diagram of the heat flow and of the temperature along the thickness of the internal border (wall) and of the external border (coating of the invention) in Example 6.4.
Figure 17B:
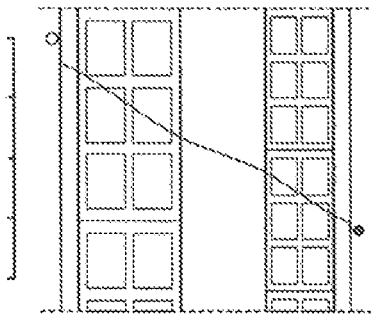
FIG. 17*b* shows a diagram of the temperature curve along the wall thickness of Example 6.4.

Referring to FIGS. 17*a* and 17*b*, in the case of a wall with masonry cassette on which is applied to the casing according to the present invention, with still air inside the interspace, given the following properties:

floor area: 100 $m^2$
Volume: 300 $m^2$
available surface: 120 $m^2$
K1: 0.33 $W/m^2K$
K2: 1.02 $W/m^2K$
T1=0.0° C. S1: 120.0 $m^2$
T2: 20.0° C. S2: 120.0 $m^2$ heat flowes are the following:

Q1: 1126 W
Q2: 1000 W
Q: 2126 W
T: 28.2° C.
K1S1: 40.0 W/K
K2S2: 122.6 W/K
T1-T2=−20.0° C.

Q2=Qv2

$\rho$=1.2 $kg/m^2$
$c_P$=1000 J/kgK
T=20.0° C.
V=300 $m^3$
n=0.5 $h^{-1}$
Hv=50 W/K
Qv=1000 W from which, via the same relationship in Example 6.3:

for ΔT1 outwards with the facade heated For $h_{int}$=11.3 $W/m^2K$, $s_1$=0.10 m, $\lambda_1$=0.0348 W/mK; $R_1$=2.87 $m^2K/W$, $H_{and}$=25 $W/m^2K$;

R=3.00 $m^2K/W$
K1=0.33 $W/m^2K$ and for ΔT2 towards the internal environment of the wall in the cassette will have $h_{int}$=11.0 $W/m^2K$, $s_1$=0.34 m, $H_{and}$=7.7 $W/m^2K$;

R=0.98 $m^2K/W$
K2=1.02 $W/m^2K$

Example 6.5

Comparison. Traditional Wall with Light External Vertical Closure

Figure 18A:
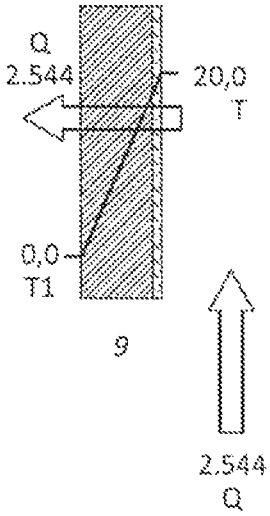
FIG. 18*a* shows a diagram of the flows of heat and of the temperature along the wall thickness of Example 6.5.
Figure 18B:
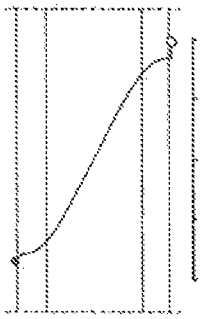
FIG. 18*b* shows a diagram of the temperature curve along the wall thickness of Example 6.5.

Referring to FIGS. 18*a* and 18*b*, in the case of a wall with vertical closing external light, given the following properties:

floor area: 100 $m^2$
Volume: 300 $m^2$
available surface: 120 $m^2$

K1: 0.64 $W/m^2K$
S1: 120.0 $m^2$
T: 20.0° C.
T1: 0.0 heat flowes are the following:

Q: 1544.4 W
Qv: 1000 W
$Q_{tot}$: 2544.4 W from which, the report:

$$K_1=1/R_t$$

with $$R_t=1/h_{int}+\Sigma(s_{ti}/\lambda_t)+1/h_{and}$$

where $h_{int}$=7.7 $W/m^2K$, $s_1$=0.99 m, $H_{and}$=25 $W/m^2K$

It allows to obtain:

R=1.55 $m^2K/W$
K1=0.64 $W/m^2K$

Example 6.6

Wall with Thermal Shell of Vertical Closure External Light

Figure 19A:
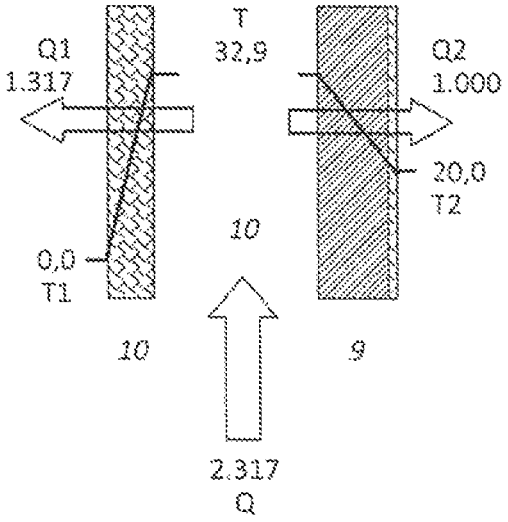
FIG. 19*a* shows a diagram of the heat flow and of the temperature along the thickness of the internal border (wall) and of the external border (coating of the invention) in Example 6.6.
Figure 19B:
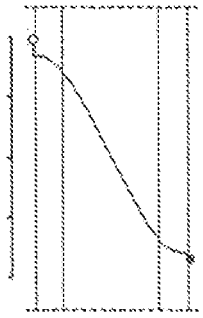
FIG. 19*b* shows a diagram of the temperature curve along the wall thickness of Example 6.6.

Referring to FIGS. 19*a* and 19*b*, in the case of a wall with vertical closing external light to which it is applied to the thermal shell according to the present invention, with still air inside the interspace, given the following properties:

floor area: 100 $m^2$
Volume: 300 $m^2$
available surface: 120 $m^2$
K1: 0.33 $W/m^2K$
K2: 0.64 $W/m^2K$
T1=0.0° C. S1: 120.0 $m^2$
T2: 20.0° C. S2: 120.0 $m^2$ heat flowes are the following:

Q1: 1317 W
Q2: 1000 W
Q=2317 W
T: 32.9° C.
K1S1: 40.0 W/K
K2S2: 77.2 W/K
T1-T2=−20.0° C.

Q2=Qv2

ρ=1.2 $kg/m^2$
cP=1000 J/kgK
T=20.0° C.
V=300 $m^3$
n=0.5 $h^{-1}$
Hv=50 W/K
Qv=1000 W from which, via the same relationship in Example 6.5:

for ΔT1 outwards, with the front heated, you $h_{int}$=11.3 $W/m^2K$, $s_1$=0.10 m, $\lambda_1$=0.0348 W/mK; $R_1$=2.8 7 $m^2K/W$, $H_{and}$=25 $W/m^2K$;
R=3.00 $m^2K/W$
K1=0.33 $W/m^2K$ and for ΔT2 towards the internal environment of the wall has $h_{int}$=11.0 $W/m^2K$, $s_1$=0.09 m, $H_{and}$=7.7 $W/m^2K$;
R=1.55 $m^2K/W$
K2=0.64 $W/m^2K$ To correctly interpret the results, it is necessary to consider in the examples in which reference is made to the configuration with adoption of the thermal shell for buildings according to the present invention, the external border is constituted by a polystyrene panel, thickness 10 cm and plaster finishing shaved.

The results obtained in terms of thermal powers provided and savings percentages, in the case of examples 6.1 and 6.2, referring to a full masonry walls, allow to say that, for the same boundary conditions, the balance of powers returns a value more than halved (almost 60% savings) in thermal powers to be given to the case by applying the thermal shell of the invention. By providing the interspace a thermal power of about 2000 W, it is possible to ensure internal environment satisfy the heat requirement calculated. On the other hand, in the case of convectional wall examined, in order to fulfill the requirements it is necessary to provide a heating capacity of almost 4900 W.

The data obtained demonstrate in this case a highly significant savings, and likewise, it is interesting to note how the heating power supplied to the interspace to be conditioned generates, within the same, at regime, for the case examined, a temperature equal to 25.2° C., then temperature was extremely close, as given relative to that of the confined environment to be conditioned, equal to 20° C.

As regards the examples 6.3 and 6.4, referring to external perimetric wall masonry cassette, respectively without and with application of the thermal shell according to the present invention, the comparison can be observed that, for the same boundary conditions, the balance of Powers returns a value equal to approximately 40% savings in heating capacity to be supplied to the heated case with application of the invention. By providing the interspace a thermal power of about 2126 W, it is possible to ensure internal environment satisfy the heat requirement calculated. On the other hand, in the case of convectional wall examined, in order to fulfill the requirements, you must provide a heating capacity of almost 3451 W.

The data obtained demonstrate, even in this case, a significant saving, and likewise, it is interesting to note, also in this case, as the heating power supplied to the interspace to be conditioned generates, all'interna of the same, in the scheme, for the case examined, a temperature equal to 28.2° C., then temperature still close, as given relative to that of the confined environment to be conditioned, equal to 20° C.

As regards the examples 6.5 and 6.6, referring to external perimetric wall light, respectively without and with application of the thermal shell according to the present invention, the comparison can be observed that, for the same boundary conditions, the balance of powers returns a amounting to almost 10% savings in heating capacity to be supplied to the heated case with application of the invention. The figure shows still a saving in this case also, although not as significant as in the previous cases. By providing the interspace a thermal power of about 2317 W, it is possible to ensure internal environment satisfy the heat requirement calculated. On the other hand, in the case of convectional wall examined, in order to fulfill the requirements, you must provide a heating capacity of almost 2544 W.

Likewise, it is interesting to note, in this case, as the heating power supplied to the interspace to be conditioned generates, inside same, in the scheme, for the case examined, a temperature of 32.9° C., a temperature relatively far away, as figure, from that of the confined environment to be conditioned, equal to 20° C.

Example 7

Conclusions Summary of the Experimental Data

The findings obtained in the preceding Examples, and especially in the examples 6.1-6.4, are very interesting with regard to satisfying the heat requirement of the building, which appears to be considerably less than that associated to the walls of the traditional type; consequently they will also lower the primary thermal powers to be used for air-conditioning environments.

The experimental data have also demonstrated how, for the same type of the external border, the performance of the system may grow to the increase in specific weight, and therefore the inertia, of the internal border.

The data obtained also demonstrate that, where the system appears correctly dimensioned for thickness and type of material, the internal interspace reaches a temperature of air of exercise altogether close to that of the confined environment served, highlighting thereby the energy the thermal shell of the invention.

The thermal shell according to the present invention can also be considered to be even more powerful if one considers the entire building-system, implementing thus the plant system in the manner specified in example 8 hereinafter.

Example 8

The System-Building Plant

The thermal shell according to the present invention is configured as a real building-system heat, consisting of the set of the building organism, comprising the casing dispersant, or the structure of the coating, with all its geometric characteristics, and the plant network for the supply of the thermal energy necessary for the maintenance of the welfare conditions within the environment inhabited.

It is possible, in the present case, as seen earlier, to exchange with the interspace appropriate amount of heat and to obtain the balance of the energy flows to ensure the fulfillment of the needs of the unit of reference.

It manages to balance the physical phenomenon of heat exchange, up to obtain an exchange of heat quantity reduced with the interspace; with the boundary conditions assumed in the interspace is sufficient to maintain a very low temperature, above 25° C.

Given the low temperature and the reduced quantity of heat to be exchanged with the interspace, the plant must generate reduced power and directly enter them in its internal.

The structure of the thermal shell coating of the invention is, therefore, configured to allow the flow of air needed, rendering it the same conduit through which the amount of heat generated by the plant are transmitted to the environment (or units) to be air conditioned (by means of forced convective exchange already shown).

In particular, it can make the unit concerned completely autonomous from the point of view of the regulation, the management and accounting of consumption, by configuring the structure of the coating, and then the interspace, in such a manner that the air flows in the horizontal direction and the heat transfer does not involve the neighboring units. In this way, the unit does not require a plant inside extra or supplementary, since it is exclusively served from the conditioning heat the thermal shell of the invention.

Ultimately, the plant configuration assumed is extremely simple, especially when compared with a traditional plant that air-conditions the environmental unit directly from within (and even more so in the case of centralized system at the service of more environmental units).

According to the present invention there are no limitations to the technology employed to generate and transfer heat to the interspace, which can then be produced by any technology in being, of convection type, which in particular heat pump technology, most performant for dimensional data considered, or radiant type/by irradiation, for example with water technology heated/cooled, and diffuse through the walls thermo radiant to be conditioned placed inside the interspace, or by means of air ducts heated by convection with hot bodies such as thermal fireplaces or derived fuels.

The plant here is provided consisting of a group thermal heat pump with reversible cycle; a small air handling units; a very small system for channeling the only connection the air handling unit to the air; and an element of modulation of the inlet flow, for the autonomous management, connectable to the unit of thermo-regulation at both fixed points that climate, placed inside the environmental.

This plant system does not require filters of any kind, or of complex insulated busbar terminals of thermal emission. And it does not affect in any way commit the internal space of the unit or the environment in the same horizontal and vertical partitions (cladding, partitions, floors, ceilings or false), and also allows a modular sizing in case of engineering development at industrial scale.

According to the above, also in economic terms the air conditioning system the thermal shell according to the present invention is very inexpensive, both in terms of initial costs that of the operating costs; and together with the remaining parts of the housing is a building-system-powered renewable energy type highly streamlined, powerful and economical.

The advantages plant according to the above shown can therefore be summarized as follows:

- Cancellation of the thermal dispersed for transmission from the unit to the outside and a consequent reduction of thermal needs for air conditioning;
- Unit isolation environment, with good performance both in winter and summer: the external border together with the interspace ensures the optimal level of insulation; the internal border constitutes a good thermal flywheel ensuring, thus, an effective inertia;
- Air conditioning unit induced by maintaining very low temperatures in space: this ensures low energy loss due to the reduced temperature difference between external space and (by the external border) and therefore low energy consumption in terms of total building envelope;
- Use of "wall thermal shell" as a vehicle of the air flow for air conditioning, avoiding any canalization and apparatus inside the environmental unit;
- Combination of building system with a very simple organism plant, with primary energy consumption greatly reduced.

In conclusion, it is possible to list the advantages the thermal shell of the invention:

- Significant energy savings (in the range 40-60%, further data can be optimized as a function of development contingent and the dimensioning of the elements of the system) for the conditioning of existing buildings or new construction;
- Cancellation of the thermal dispersed for transmission from the unit to the outside and a consequent reduction of thermal needs for air conditioning;
- Insulation keeping your environment, with good performance both in winter and summer: the external border, together with the space, provides the optimal level of insulation; the internal border is a good thermal flywheel ensuring, therefore, effective inertia; in case of interventions on the seniority, the multi-layer system the thermal shell, even in the absence of operation of the air conditioning heat, elevates the insulation of the object of the application;

Air-conditioning unit by induced, maintaining low temperatures in space: this ensures low energy loss due to the reduced temperature difference between external space and (by the external border) and therefore low energy consumption in terms of total building envelope;

Optimizing the use of ducts of air conditioning distribution system, through the use of the vehicle as the heated air flow for air conditioning, thus excluding any canalization and apparatus inside the environmental unit;

System can be used with any current technology of heat production, and specifically dimensioned with thermal unit reversible heat pump and air handling units coupled, without exclusion and limitation for the adoption of other technologies above state of the art;

Combination of building system with a very simple organism plant, with primary energy consumption greatly reduced, due to the high yields of the thermal unit, the meager jumps in temperature that the system must meet and the geometry of a simplified form of the air-conditioning system;

Installation of new systems outside of the rooms occupied and consequent lack of space due to external devices of the plants and their possible ducts/pipes;

Savings in installation costs in new buildings or existing for reduction/elimination of air ducts;

Cost savings in maintenance, for ease of inspection of the interspace and the ease of recovery in case of interventions demolition of the external border (only intended for external border plaster, in the case of external cladding cleaning is scheduled dismantling/replacement of external curtain nondestructively);

Integration with existing thermal plants; the system allows an auxiliary or full replacement of existing systems; the control system, via solenoid valves, is optionally centralized control or peripheral, for individual dwelling unit;

Raising the living comfort on the air conditioning, industrial heat-radiant heat and not confined to convection, with obvious elimination of all conditions of discomfort given by traditional air systems.

The present invention has been described at the ter illustrative but not limitative purposes according to its preferred embodiments, but it is to be understood that variations and/or modifications can be apport to you by those skilled in the art without departing from the related scope of protection, as defined by the appended claims.

The invention claimed is:

1. A thermal shell for a building comprising a covering structure for surrounding a building having an interior, or part of a building having an interior, wherein said covering structure comprises, proceeding from an outside environment towards the interior of the building: a coating, a thermal insulating layer, an interspace and a heat radiating wall where said interspace is positioned between said thermal insulating layer and said heat radiating wall wherein the interspace contains air, is closed and isolated with respect to a surrounding environment outside said building and is closed with respect to a surrounding environment inside said building; and wherein the thermal shell additionally comprises means for thermal conditioning of the air contained in the interspace;

so that the heat of the air contained in the interspace is transmitted to the interior of the building by heat radiation.

2. Thermal shell according to claim 1, wherein the means for thermal conditioning of the air in the interspace are heat radiating means.

3. Thermal shell according to claim 1, wherein the means for thermal conditioning of the air in the interspace are of the type that operates by means of forced air convection and comprise a suction inlet of air to be conditioned and an outlet of a forced flow of conditioned air, wherein said outlet is in fluid connection with the interspace; wherein the thermal shell additionally comprises means for recirculating air from the interspace to the means for thermal conditioning of the air;

wherein the means for recirculating air comprise a pipe connected to said suction inlet of the means for thermal conditioning of the air.

4. Thermal shell according to claim 3, wherein the thermal shell comprises a second interspace, arranged externally with respect to said interspace.

5. Thermal shell according to claim 3, wherein the means for thermal conditioning of air comprise a thermal conditioner.

6. Thermal shell according to claim 3, wherein the means for thermal conditioning of air comprise a fan heater.

7. Thermal shell according to claim 3, wherein the means for thermal conditioning of air comprise a fan coil.

8. Thermal shell according to claim 3, wherein the means for thermal conditioning of air comprise an air conditioner.

9. Thermal shell according to claim 1 wherein the covering structure is composed of panels.

10. Thermal shell according to claim 2 wherein the covering structure is composed of panels.

11. Thermal shell according to claim 3 wherein the covering structure is composed of panels.

12. Thermal shell according to claim 4 wherein the covering structure is composed of panels.

13. Thermal shell according to claim 5 wherein the covering structure is composed of panels.

14. Thermal shell according to claim 6 wherein the covering structure is composed of panels.

15. Thermal shell according to claim 7 wherein the covering structure is composed of panels.

16. Thermal shell according to claim 8 wherein the covering structure is composed of panels.

* * * * *